United States Patent [19]

Dunlap

[11] 4,192,709

[45] Mar. 11, 1980

[54] CREPING DOCTOR

[75] Inventor: Harold E. Dunlap, Auburn, Mass.

[73] Assignee: Thermo Electron Corporation, Waltham, Mass.

[21] Appl. No.: 926,755

[22] Filed: Jul. 21, 1978

Related U.S. Application Data

[63] Continuation-in-part of Ser. No. 762,308, Jan. 25, 1977, abandoned.

[51] Int. Cl.[2] ..... D21G 3/02; D21G 3/04

[52] U.S. Cl. ..... 162/111; 15/256.51; 162/281

[58] Field of Search ..... 162/111, 281; 15/256.51

[56] References Cited

U.S. PATENT DOCUMENTS

| | | | |
|---|---|---|---|
| 1,845,716 | 2/1932 | Lafore | 15/256.51 |
| 1,883,167 | 10/1932 | Vickery | 15/256.51 |
| 1,945,761 | 2/1934 | Vickery | 15/256.51 |
| 2,330,889 | 10/1943 | Holcomb | 15/256.51 |
| 2,477,339 | 7/1949 | Ljungquist | 15/256.51 |
| 2,915,421 | 12/1959 | Miller | 15/256.51 X |
| 3,113,890 | 12/1963 | Johnson et al. | 15/256.51 X |
| 3,163,878 | 1/1965 | Smith et al. | 15/256.51 |
| 3,229,662 | 1/1966 | Means | 15/256.51 X |
| 3,529,315 | 9/1970 | Dunlap et al. | 15/256.51 |
| 3,778,861 | 12/1973 | Goodnow | 15/256.51 |
| 4,114,228 | 9/1978 | Brown | 15/256.51 |

*Primary Examiner*—Richard V. Fisher

*Attorney, Agent, or Firm*—Thompson, Birch, Gauthier & Samuels

[57] ABSTRACT

A creping doctor in which a long, thin blade is applied to a roll surface at an angle to the tangent at the line of contact such that the blade presents a wide surface to the product being removed from the roll. A preferred angle is approximately normal to the surface, so that the roll surface tangent and the wide blade surface receiving the product make an angle ranging between acute and obtuse. A bladeholder provides both coarse and fine compliance of the blade to roll surface contour variations. Blades incorporating resilient means distributed along the back edge for cooperating with the bladeholder are also described.

22 Claims, 12 Drawing Figures

10
11
12
13
14
15
16
18
19
20
21
22
23
24
24'
25
26
27
30
31
31'
32
33
34
35
36
37
40
41
43
44
46
52
53
54
56

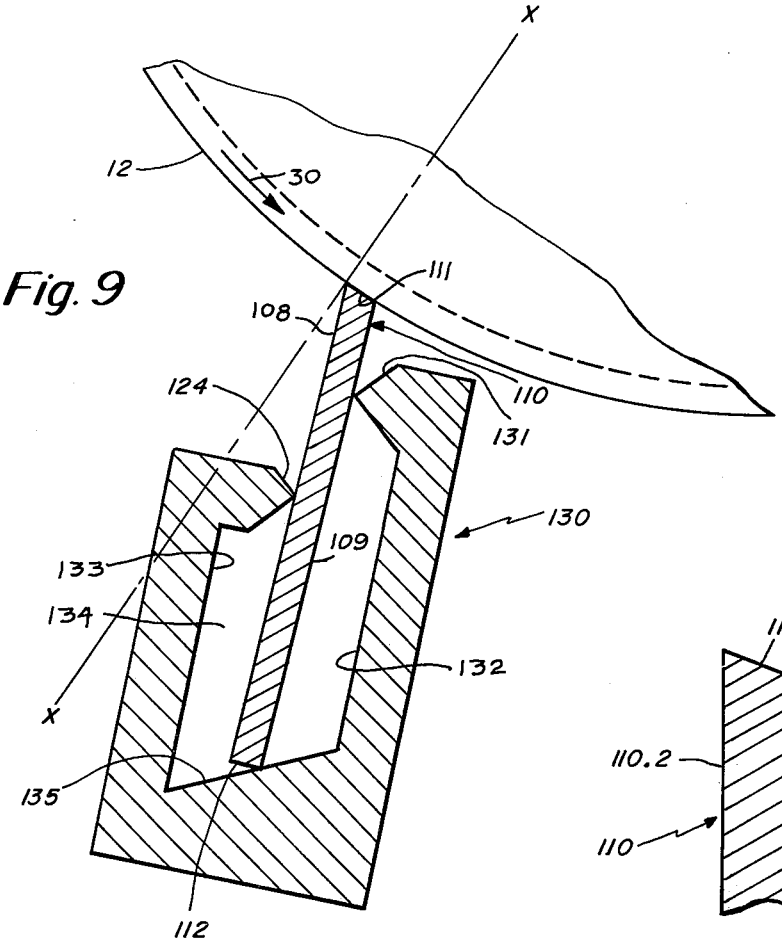
Fig. 9
Fig. 10
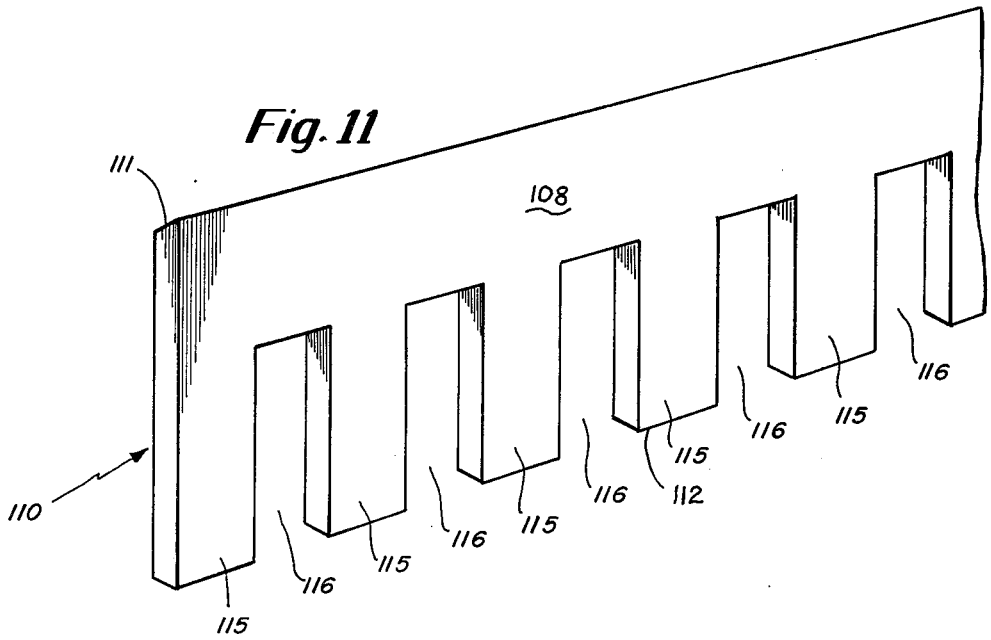
Fig. 11

CREPING DOCTOR

CROSS REFERENCE TO RELATED APPLICATIONS

This application is a continuation-in-part of U.S. Ser. No. 762,308 filed Jan. 25, 1977, now abandoned.

BACKGROUND OF THE INVENTION

The art of making bladeholders for doctors and scrapers is old, yet continues to develop. The task of doctoring or scraping a moving work surface, as on a roll or cylinder, for example, present problems of approach to the load, operational control, and blade wear and replacement, which continue to engage paper makers and others facing the task. In the paper industry, doctors and scrapers are employed to clean the surfaces of rotating calendar rolls, drier cylinders and the like; and scrapers are used to remove a web of paper as in the manufacture of crepe paper (creping doctor). Scrapers (sometimes called "knives") are used to remove product from drums in flakers and drum driers used to prepare dried products of various kinds (example being food stuffs, pharmaceuticals, chemicals, films solidified from liquids) from a starting liquid or paste.

When the surface to be doctored or scraped (working surface) is that of a material soft enough to be damaged by a blade or knife approaching it at an angle that favors digging in, chipping or otherwise injuring the working surface, it is important that the bladeholder control not only the angle at which the blade engages the work surface during operation, but also the angle at which the blade approaches the work surface when being brought into position for operation.

Blades wear out in use, and many attempts have been made to extend blade life. Attention has been given to special treatments of the working edges of blades, to improve the lasting qualities and efficiencies of the working edges. Attention has also been given to making blades having reserve body structure and adjustable holding features such that, in combination with a bladeholder incorporating cooperating adjusting features, the blade can be adjusted to compensate for wearing away of its working edge.

Much attention has been given to problems of operational control. Doctor and scraper blades are generally long, thin structures as much as one to six inches wide and extending sometimes as much as 35 feet or more from one end to the other, across a working surface transversely to the direction of relative motion of the working surface. In paper machinery, the long dimension of the blade is in the "cross-machine direction" (CMD). Obviously, the blade is subject to flexure in the CMD, and a high spot on the working surface, due to debris, for example, can lift the blade from the working surface in the vicinity of the high spot, and create conditions of non-uniform pressure between the blade working edge and the working surface in the CMD. This is a transitory, or dynamic flexure problem. There exists also a static problem of blade flexure to accommodate roll crown and the like.

It is known in Scallen's U.S. Pat. No. 488,455, and Harvey U.S. Pat. Nos. 429,381 and 481,866 that nonmetallic scraper blades may be mounted substantially perpendicular to a roll in a roller mill and used (in Harvey) to prevent the accumulation of crushed grain on the roll in the manufacture of flour. The blades are made of leather, wood, paper board, or hard rubber, and a purpose is stated by Harvey to be to remove danger of fire or abrasion of rolls. Scallen teaches adjustment to contact the roll. In Vickery U.S. Pat. No. 1,883,167 a doctor for paper making machinery is shown with a blade positioned at an angle about 45° or less to the roll and held by a rigid support with the blade pressed against the roll by spring means bearing on said blade. Vickery U.S. Pat. No. 1,945,761 shows a curved blade having a rear edge clamped to a rigid carrier and its consumable forward part adapted to bear edgewise on a roll. LaFore U.S. Pat. No. 1,845,716 shows an early example of a doctor blade with thin slots extending inward from its rear edge, in a so-called "floating" mount.

Holcomb U.S. Pat. No. 2,330,889 describes a paper making roll doctor having a blade support and blade loading means employing a plurality of separate pressure fingers, operable against a side of the blade, which are individually controlled to force the blade into resilient contact with the roll. Actuable means are described to control the movement of pressure fingers against a side of the doctor blade.

In Miller, U.S. Pat. No. 2,915,421 a straight blade mounted to engage a roller radially along its center line, primarily for cleaning purposes, is shown with spring means at the back edge of the blade to press radially inwardly on said blade for forcing the front edge of the blade against said roller.

Generally, representative prior solutions to blade flexure and roll-contact problems are described in Ljungquist U.S. Pat. No. 2,477,339; DST Pattern and Engineering U.S. Pat. No.'s 3,163,878 (Smith et al) and 3,529,315; (Dunlap et al); and Goodnow 3,778,861.

Despite the fact that the art of paper making is by now quite old, the manufacture of crepe paper with the aid of a creping doctor presents problems which affect the quality and quantity of finished product. Present creping doctors used in the industry require relatively frequent blade changes due to the type of wear on the blade edge in contact with a cylindrical drier or the like. As can be seen in FIG. 1 at position A, a conventional creping doctor blade 10' is typically positioned with one side of its front edge against a cylindrical roll, such as a Yankee dryer, and as the roll moves in the direction of the arrow 30, the blade will wear away the front edge 1 and eventually take on a knife-edge shape as shown in FIG. 1, position B. Due to this type of blade wear, the quality of a product manufactured may progressively change, and with it the operational efficiency.

The art of creping paper, food stuffs or some other material requires the accurate, uninterrupted, and uniform removal of the web material from its carrying surface, normally a cylindrical surface. In order to do so the blade must be positioned so that it presents a creping surface making an acute angle to the oncoming direction of the material web. As is shown in FIG. 1 at position B, a blade in the conventional position wears so that the creping surface 1 of the blade decreases in thickness until it is not sufficiently wide for creping purposes. In this condition of wear, the blade is acting as a scraper and thus should be replaced. As wear progresses from the initial condition, as shown in FIG. 1 at position A, to conditions approaching that of FIG. 1 at position B, the worn "heel" or width of surface contacting the rotating drum substantially increases, thus reducing the unit loading (PSI) between these surfaces. When the blade has worn to a state as shown in FIG. 1 at position B, there exists a tendency for the leading edge, point 1, to lift or curl away from the roll. This lifting associated with the leading edge is due to the thinned condition of metal at the leading edge and its exposure to the heat generated by the friction between blade and roll. Reduced unit loading and edge curl enhances the possibility of paper fibers lodging under the crepe blade, a condition called picking, resulting in disruptions of the uniformity of the creped product. This wear characteristic of conventional creping doctors require frequent blade changes resulting in substantial machine down-time for industry. Considering the fact that modern paper machines are operated at high speeds, generally at two to four thousand feet/minute, machine down-time is a significant problem for industry.

Conventional creping doctors cause a significant amount of friction between blade and roll. This is due to the fact that the total applied load force on the working edge of the blade is high in order that the creping doctor maintain a suitable creping position for the narrow blade edge. The presence of high friction substantially increases the energy required to rotate the cylindrical dryer or roll. In today's age of expensive energy sources, the increased energy requirements present severe economical drawbacks to the present mode of creping.

Additionally, the heat caused by the friction between blade and roll causes the relatively long, (normally as much as 30 feet) blade to ripple at the working edge, resulting in an uneven contact between blade and roll. With an uneven contact between blade and roll, fiber will tend to slide under that portion of the blade that is lifted off the roll, thus aggravating the problem of edge ripple.

GENERAL NATURE OF THE INVENTION

The present invention provides a creping doctor that positions a relatively thin elongated blade with its width dimension generally radially oriented; for example, at an angle less than 90° from the oncoming direction tangent to a roll surface, as is illustrated in FIG. 1 at position C, in a so-called drag position, or at an angle that is 90° or more than 90°, along the entire length of the roll surface as illustrated in FIG. 9. The blade can be substantially flat, as shown for example in FIG. 2, or it can be curved at its back edge as shown for example in FIGS. 5 and 7, so that it fits flexibly within the supporting jaws of its holder. The bladeholder apparatus supports the jaw mechanism at the ends of an array of pivotally-mounted pressure fingers cooperating with pressure-distributing means to cause the blade to be loaded edgewise against the roll surface. The pressure applied to the fingers allows the blade to be more uniformly pressed against the roll so that variations in pressure along the line of contact between the blade and roll are minimized.

The jaw mechanism supports the elongated blade at an angle which is 90° or more or less than 90° from the upstream tangent to the roll, within a range of angles that may be termed "generally radial". The jaw mechanism has a first jaw and second jaw component between which is located an opening to receive the doctor blade. The first jaw is located on the downstream side of the blade relative to the traveling direction of the roll surface, while the second jaw is located on the upstream side of the doctor blade. The first jaw extends closer to the roll surface than the second jaw. The first jaw has means, such as an edge, for contacting the blade pivotally along a first contact line parallel to the working edge of the blade, and on one wide side, the "downstream" side, of the blade. The second jaw has means, such as another edge, for contacting the blade along a second contact line parallel to the first, and on the other wide side, the "up-stream" side, of the blade. The first contact line is nearer to the roll surface than the second contact line. When the working edge of the blade engages the surface of the turning roll, the blade is caused to pivot around the first contact line into contact with the second jaw means at the second contact line. In operation, the jaw mechanism allows the blade to deflect radially relative to the roll, which improves conformity with the roll surface, minimizing the existence of a "picking" problem. The bottom of the jaw opening may be shaped to contribute to the pivotal motion around the first contact line under reactive force to contact between the blade and the roll.

The pressure fingers are urged to provide loading of the blade against the roll by a flexible tube, preferably filled with a fluid, disposed to provide the necessary force between a pad affixed to each finger and a base which is rigidly affixed to the doctor back supporting the bladeholder. The flexible tube and the base run the length of the bladeholder assembly. The fingers are held biased toward the tube by means of flexible springs, and each spring is cocked or pre-loaded by a bolt or the like attached to the doctor back. This bolt provides loading adjusting means whereby the blade may be adjusted within a substantial range of desired loading. The pressure fingers are pivotally mounted each about a pivot which rests on the doctor back and is held in place by a back pivot-holder. To protect the pressure fingers and other elements of the bladeholder apparatus from the environment of paper making or the like the apparatus may be enclosed within cover shields.

The jaw mechanism holding the blade in creping position is bolted on each finger by suitable bolting means. In addition, attached to each finger is a separate pad, the contact with the flexible tube, as mentioned above. These pads also provide contact support to the individually adjustable flexible springs mentioned above which apply pressure through the pads to urge each finger against the flexible tube.

In operation the blade is held in a position so that it is essentially at an angle that is "generally radial", as herein specified, to the roll and in edge-wise contact at its working edge with the surface of the roll. As the web of paper or other material is carried on the roll toward the blade, that surface of the blade which confronts the on-coming roll surface, that is, the "up-stream" wide side, is used for creping or product removal. This configuration presents a much wider surface for creping than does the narrow edge of the blade as in the prior art configurations. This new configuration has many advantages. The possibility of the blade digging into the roll is virtually eliminated. Since the blade is now disposed at a generally radial angle to the cylindrical roll, blade wear will occur at the edge surface of the blade. The blade edge in contact with the roll surface maintains a substantially constant width, thus maintaining substantially uniform unit loading during the entire working life of the blade. The blade need not be as thick or as wide as conventional blades, representing material cost saving to industry. As the blade continues to wear, the angle it presents to the oncoming web of material on the roll stays essentially the same for greater periods of time, thereby eliminating gradual deterioration of product and efficiency. In fact, the positioning of the doctor blade is such that the blade may wear down to the jaw mechanism before blade replacement or adjustment is necessary. Consequently, the amount of machine down-time made necessary for blade changes is significantly reduced. The reduction of machine down-time due to the employment of the bladeholder apparatus allows the industry to produce a uniform quality of product with less waste and at a lower cost.

An additional operational advantage of the novel bladeholder apparatus of the invention is that the amount of friction between blade and roll is less than the friction caused by the prior art conventional devices. The lower amount of friction is due to the capability of the bladeholder apparatus to effectively operate with a smaller total applied loading force, due to the constant width of contact area. This operational advantage results in energy savings, in that less horsepower is needed to drive the roll under load.

To achieve uniformity of loading, despite variations in the doctored surface, the present invention provides for several profile compensating mechanisms. For gross variations such as the crown on the dryer roll or the like, the pressure finger flexible tube arrangement provides gross profile compensation. For fine profile variation compensation the flexibility of the blade, itself, provides fine profile compensation. In some embodiments of the invention there are novel profile variation mechanisms that compensate for those variations that are too large for blade flex compensation, providing a so-called intermediate profile compensation mechanism. One such embodiment comprises a blade wherein its rear edge (opposite to the working edge) is notched at regular spacing along essentially the entire length of the blade. In a variation, tab-like projections which are uniformly bent to form curved-spring elements are provided between the notches. These spring elements can be shaped and sized to various configurations to obtain optimum performance consistent with the blade material, blade thickness, and anticipated operating conditions; they cooperate with a jaw mechanism providing bottom support for localized loading of the roll on the working edge of the blade such that the opposing reaction imposed by the jaw mechanism causes each individual tab to deform independently at a rate that is essentially proportional to the load on each tab. The deformations or deflections of the tabs function in such a way as to further reduce inconsistencies in blade loading on the roll. The notched, curved or spring-tab blades provide additional operational advantages in their ability to minimize the effect of heat, caused by the friction between roll and blade, on the working edge of the blade.

The entire bladeholder assembly is mounted on suitable support means for bringing the blade into proper creping position.

BRIEF DESCRIPTION OF THE DRAWINGS

FIG. 9 is a schematic view of a generalized bladeholder according to the invention;

FIG. 10 is a fragmentary section of a blade having a sloped working edge; and

FIG. 11 is a partial plan view of a notched blade fitted with wide notches.

DETAILED DESCRIPTION OF THE DRAWINGS

Figures 2, 2A:
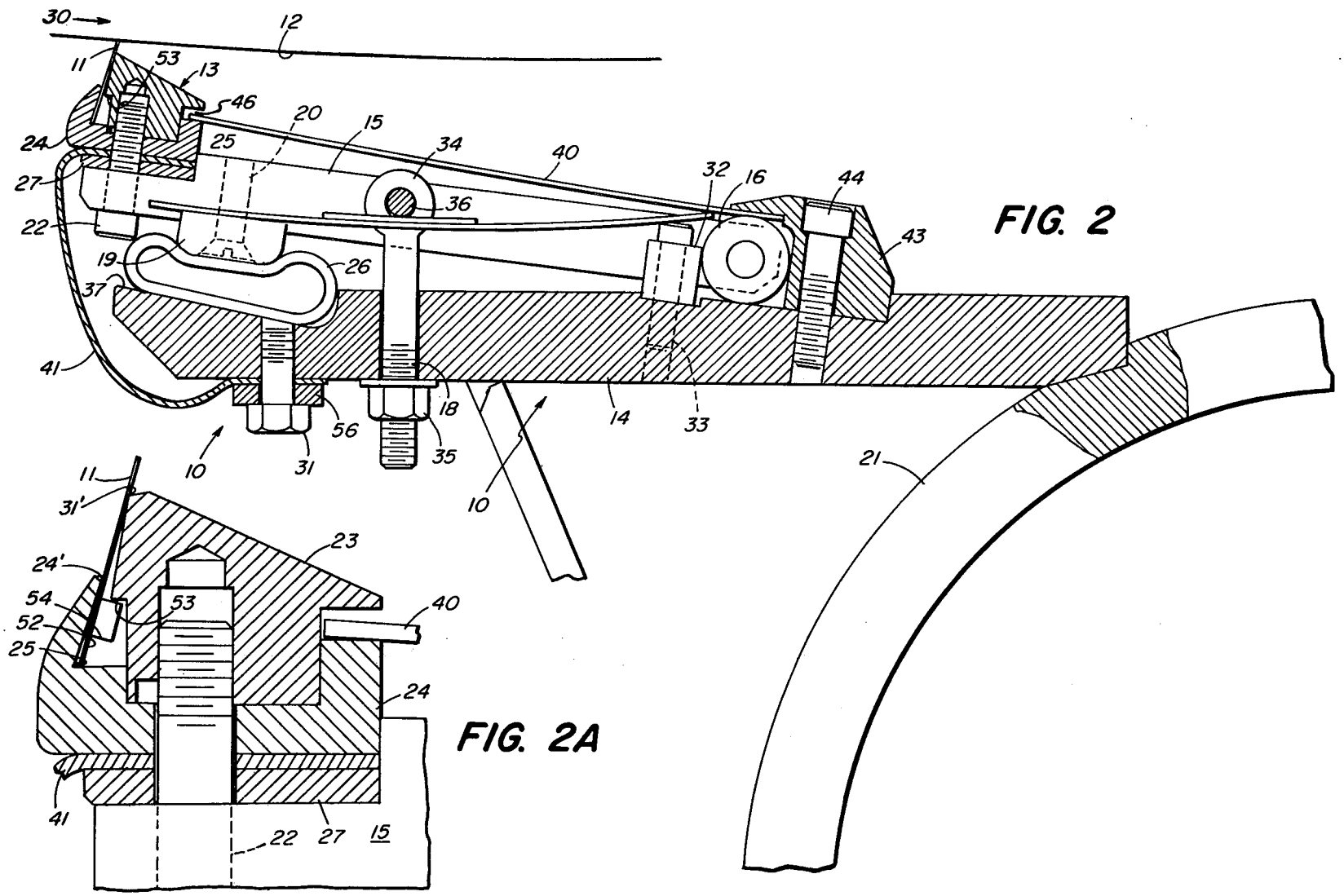
FIG. 2 is a sectional view of a bladeholder apparatus with a straight creping blade installed.
FIG. 2A is an enlarged sectional view of the straight blade jaw apparatus in FIG. 2.
Figure 3:
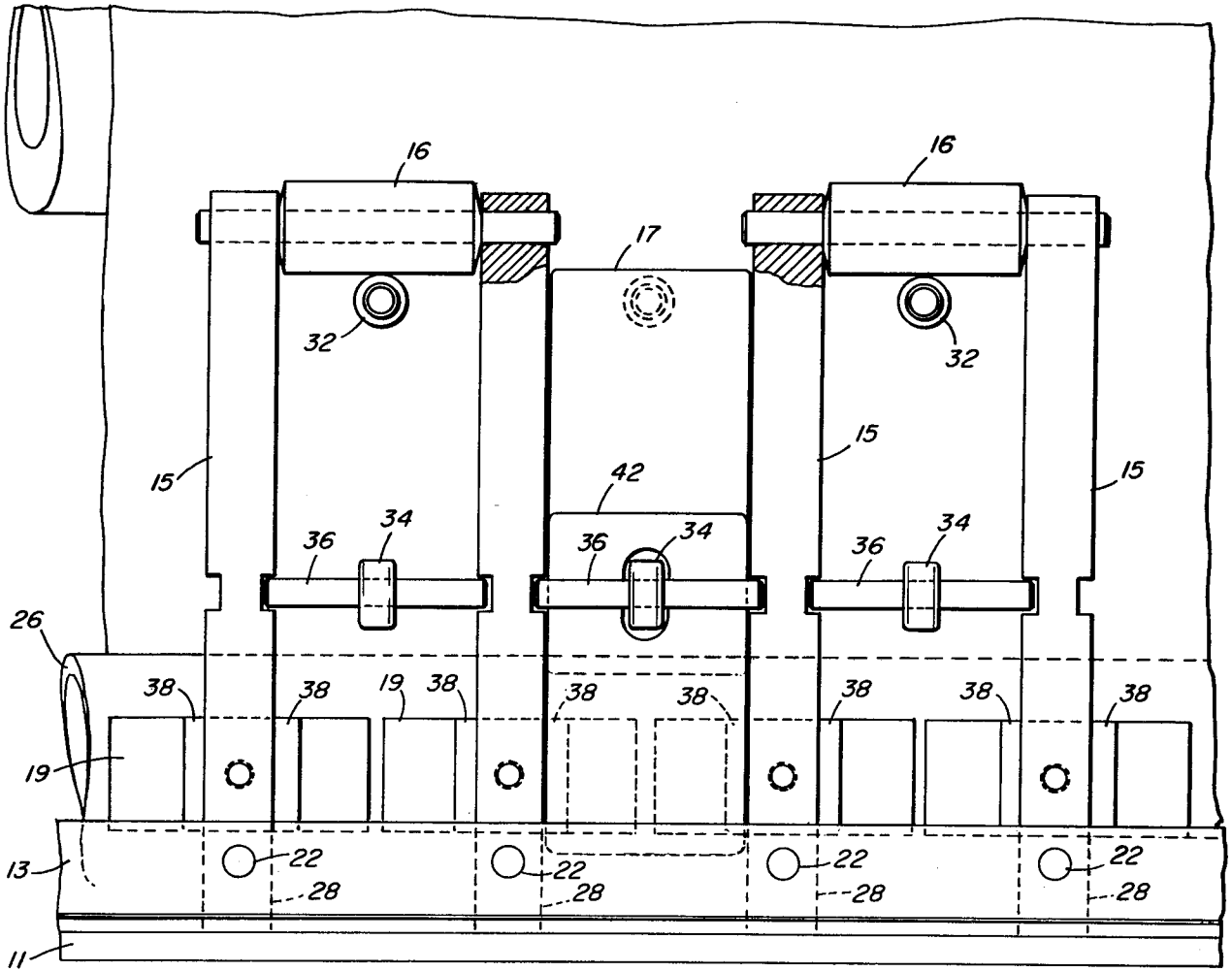
FIG. 3 is a top view, partially in section of the bladeholder apparatus.
Figure 4:
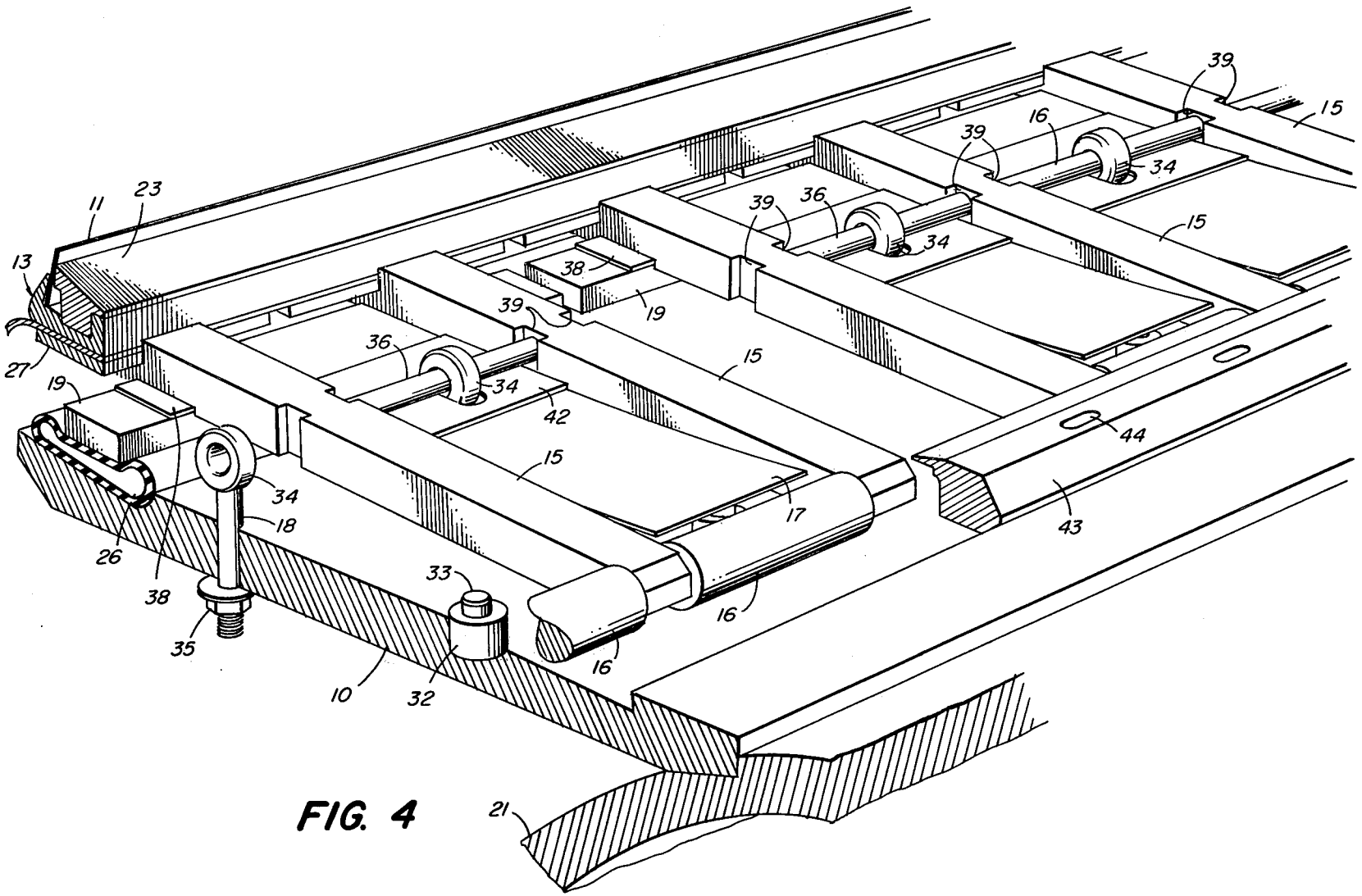
FIG. 4 is a perspective view of the bladeholder apparatus, partially in section.

FIGS. 2–4 illustrate a bladeholder apparatus 10 holding a blade 11 positioned at an angle less than 90° to the oncoming tangent to a roll surface 12 in a jaw apparatus 13 that is resiliently supported on a doctor back 14 mounted on a member 21. Support for the jaw apparatus includes a flexible tube 26 running substantially the entire length of the apparatus 10, a plurality of pressure fingers 15 each pivotally secured at one end to a pivot 16 that is firmly held on the doctor back by a spacer 32, and having at the other end a pad 19 attached to each finger 15 by bolting means 20, the flexible tube 26 being located between the pads 19 and a platform part 37 of the doctor back. A plurality of flat flexible springs 17 force the pads 19 to press against the profiling tube 26. The jaw apparatus 13 is supported on the ends of the pressure fingers 15 remote from the pivots 16.

The jaw apparatus 13 as shown in expanded view in FIG. 2A, comprises two components 23 and 24, which are secured to each individual pressure finger 15 by an individual bolt 22. The first component 23 has a forward edge 31' which is closer to the working edge of the blade 11 (and to the roll surface 12, in use) than is the forward edge 24' of the second component 24; a jaw space between the two components 23, 24 is bounded between these two forward edges. Referring to the direction of rotation as indicated by the arrow 30, the second component 24 is in front of, or "up-stream" of the first component 23, and when the blade 11 is brought into contact with the moving roll surface 12 the frictional force imposed on the working edge of the blade moves the blade against the forward edge 31' of the "down-stream" component 23. The jaw space provides room for the blade to pivot around the down-stream edge 31', along a first contact line in the down-stream wide surface of the blade, so that the up-stream wide surface of the blade makes contact with the forward edge 24' of the second component along a second contact line in the up-stream wide surface. The first contact line is nearer to the working edge of the blade than is the second contact line. In this posture, the blade 11 can be held stably in the jaw apparatus, while in use. It is characteristic of this jaw apparatus that the blade can pivot around the down-stream contact line but not around the up-stream contact line, as it is brought into use. Other features of the jaw apparatus, to be described, enhance this characteristic, to provide stable operation of the new doctor apparatus over a substantial range of generally radial angles.

The second component 24 has an inward surface 25 for receiving a straight rear portion 52 of the blade 11. On rear portion 52 is attached tab 54 to be in contact with a shoulder 53 on component 23, so as to retain blade 11 from moving out of the jaw space in mechanism 13. The differential distance between the forward edges 31' and 24' from the working edge of the blade 11 allows the blade to deflect slightly in use, between its long edges, so as to enhance fine scale conformity of the working edge to the roll surface 12.

Each pressure finger 15 is a bar of metal or other suitable rigid material pivotally mounted at its inner end to the pivot 16 and constrained under opposing forces on the pad 19 at its other end by the interaction of a flexible spring 17 and the profiling tube 26. The pressure fingers 15 are approximately three inches apart on center, more or less, along approximately the entire axial length of cylindrical surface 12. A pad 19 is attached to each finger, as by bolt means 20. As can be appreciated by those skilled in the art, the pads 19 can be attached to each pressure finger by die casting or the like. As will be better illustrated below, a pad 19 is attached to each finger 15 so that an approximate equal length of pad 19 protrudes to either side of each finger 15. Each pad 19 is of a rectangular configuration, but as can be appreciated, it could be of any desired shape so long as it is able to support the flat spring 17. A supplemental pad 38 is also attached to each pressure finger 15, by the bolt means 20 or otherwise, beween the pad 19 and the finger 15. Each pad 38, which may be, typically, 60 mils thick, is supported on the larger pad 19 so as to present a raised surface to support the flat spring 17.

One of the springs 17 is positioned between each two adjoining pressure fingers 15 (refer to FIG. 3) so that it is supported on the supplemental pads 38 at one end and upon a spacer 32 at its other end. Thus, each flat spring 17 is supported at three regions of contact, allowing the flat flexible springs 17 to present a pre-load force on each individual pressure finger. This allows each pressure finger 15 to more accurately compensate for profile variations in the roll surface 12. Between pads 19 and spacers 32, which are attached to the doctor back 14 by bolt means 33, the springs 17 are attached to the doctor back 14 by eye-bolt means 18, each comprising an eye bolt 34 which is mounted through a flat spring 17 and the doctor back 14 and secured to the doctor back 14 by a nut 35. At the head of each dye bolt 34 and passing through it is a cylindrical bar 36 which makes end-wise contact with the adjoining pressure fingers 15. The pressure fingers 15 are notched at appropriate location to receive the bars 36 at their ends. Each bar 36 rests on a resilient bearing pad 42, which in turn rests on a flat spring 17.

In operation, each spring 17 is pre-loaded or cocked by the positioning of the spring on two supplemental pads 38 and a spacer 32, and its attachment to the doctor back 14. Adjustment of each bolt 18 can be made to provide a range of pre-loading forces distributed along the blade 11. The bolts 18 can be adjusted so that the blade 11 is lifted in part from contact with roll surface 12. This mode of operation may be desirable for those portions of roll surface 12 not covered by the web of creping material. Failure to lift or reduce loading of blade 11 from exposed areas of roll surface 12 may result in scouring damage to the roll surface.

The forces applied to pads 19 through supplemental pads 38, by the springs 17 cause the pads 19 to press against the flexible tube 26. Flexible tube 26 is positioned on a continuous surface 37 of the doctor back 14, and extends the entire length of bladeholder apparatus 10. The surface 27 provides a reference platform for the flexible tube 26. The flexible tube 26 is constructed on a reinforced elastomer or other similar material, and is partially filled with a fluid so that when a force is applied to any part of the surface of tube 26 a responsive force occurs distributed along the tube. The result is that the flexible tube 26 allows the blade 11 to be loaded against the roll surface 12 in such a way as to provide gross profile compensation with substantially constant loading on the roll surface 12.

Positioning and supporting the blade 11 in the generally radial position illustrated in FIGS. 2 and 2A, for example, provides for creping of material carried on roll surface 12 at a total applied load force less than conventional creping doctors. Thus, the creping doctor can operate with less friction generated between the roll surface and the blade. The resulting reduction of heat at the working edge of the blade 11 enhances the wear characteristics and longevity of the blade.

Covering the blade holding apparatus 10 are cover shields 40 and 41. The first cover shield 40, typically metal, is mounted between the pivot 16 and the doctor back holder 43 at one end and is mounted in a slot 46 in jaw apparatus 13 at its other end. The second cover shield 41, typically fabric, is secured at one end to blade holder apparatus 10 by fitting it at an edge between the second jaw component 24 and a back-up plate 27, attached to an upper surface 28 of each pressure finger 15, via the bolts 22. Each back-up plate 27 is substantially the same axial length as a pad 19. Cover shield 41 is thus prevented from drooping to a location too close to the roll surface 12. At its other end, the second cover shield 41 is attached to the doctor back 14 by a backing bar 56 and bolt means 31. Backing bar extends substantially the entire length of the bladeholder 10. These cover shields are used to protect the enclosed elements of bladeholder apparatus 10 from the contaminants present during a creping process.

In FIG. 3 is shown the structural relationship between pressure fingers 15; pads 19 and 38; pressure producing springs 17; pivots 16; spacers 32; and, eye bolts 34 with bars 36. Pressure fingers 15 are arranged so that they are approximately parallel to each other while being perpendicular to the rotational axis of cylindrical surface 12. Pivot 16 is configured so that it supports and allows rotational motion of two pressure fingers. Thus, for every pair of pressure fingers there exists one pivot 16. Blade 11 is shown contained within jaw apparatus 13 which is shown mounted on each individual pressure finger 15 at surface 28 by an individual bolt 22.

FIG. 4 shows a perspective view of the bladeholder apparatus 10. Shown is the relationship between a number of the pressure fingers 15; pads 19; flexible tube 26; and, jaw apparatus 13 supporting blade 11. Pivots 16 are maintained in position by back holder 43. Back holder 43 is secured to doctor back 14 by bolt means 44. Each individual pressure finger 15 allows the blade 11 to maintain constant contact with cylindrical surface 12. Thus, although there might be imperfections in cylindrical surface 12 that would tend to raise or lower blade 11, the bladeholder apparatus 10 is designed to conform to these imperfections.

Figure 5:
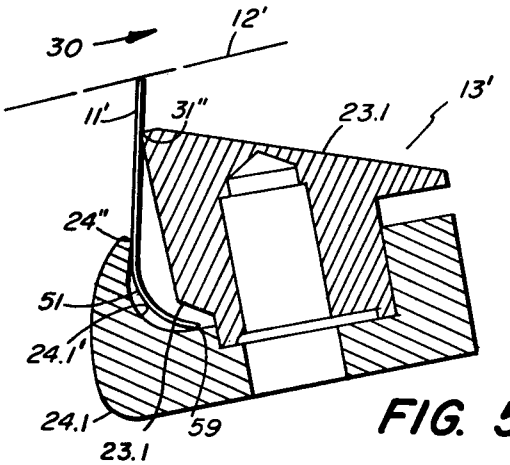
FIG. 5 is an enlarged sectional view of a curved spring-tab creping blade positioned in its jaw apparatus.

FIG. 5 shows another embodiment 13' of the apparatus, adapted to support and position a spring-tab blade 11' curved at its back edge 51. The dashed line 12' represents a tangent to the moving roll surface (12, in FIG. 1). Jaw apparatus 13' supports blade 11' along contact lines at 31'' and 24'', as previously explained for support of blade 11. Surface 24.1' of the second jaw component 24.1 is inwardly curved for receiving the curved rear portion 51 of blade 11', and the confronting surface 23.1' of the first jaw component 23.1 is correspondingly undercut away from the curved surface 24.1' of the second jaw component 24.1. The curved rear portion 51 of blade 11' is in supporting contact with surface 24.1' at an indeterminate location 59.

In operation, blade 11' provides an additional profile compensation mechanism that adjusts to intermediate size or spaced-loading profile variations. When an intermediate size loading variation appears at the working edge of blade 11', blade 11' converts the axial load force on the working edge to a radial load forced at curved portion 51. By doing so, blade 11' is caused to be in rigid supporting contact with jaw component 24.1 at location 59. The support of blade 11' at location 59 provides for an axial force to be applied at the working edge in a direction opposite to the profile variation force and essentially equal in magnitude. Thus blade 11' can respond to axial forces, on its working edge, that might otherwise lift the working edge of a straight blade.

Spring-tab blade 11' presents additional operational advantages beyond those already described. The curve portion 51 of blade 11' is self-retaining in jaw mechanism 13', thus presenting no need for retaining tabs or the like. Additionally, jaw components 23.1 and 24.1 are further apart from each other than the straight blade jaw components. This allows the jaw space between the components to be cleaned more easily and thus machine down-time due to periodic cleaning is reduced.

Figure 6:
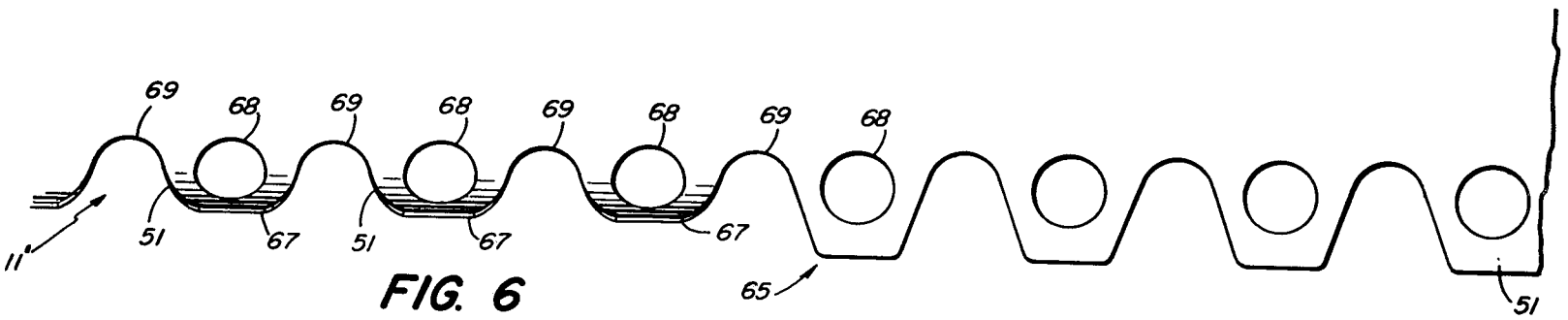
FIG. 6 is a side view of a creping blade with integral resilient spring members along one edge.

Spring-tab blade 11' is shown in plan view in FIG. 6. An array of tabs 65 is provided at the rear part 51. These are curved as shown at 67, to provide resilient flexibility around the bend 51. Each tab contains a relief hole 68. Between each adjacent pair or tabs 65 is a notched groove 69. The tab-groove configuration provides resilient support to the blade at its rear portion 51 so that the blade can apply a resilient load at its front or working edge, is response to a profile variation on the roll surface 12. The hole 68 in each tab reduces the amount of blade material at the curved portion 51, allowing for greater flexibility of the tabs. In addition, the curved tabs 67 have the operational advantage of providing heat release slots 69 so that working edge ripple caused by the heat between blade 11' and roll surface 12 is minimized. The straight tabs 65 are shown to illustrate the shape of a tab before it is curved into a resilient spring.

Figure 7:
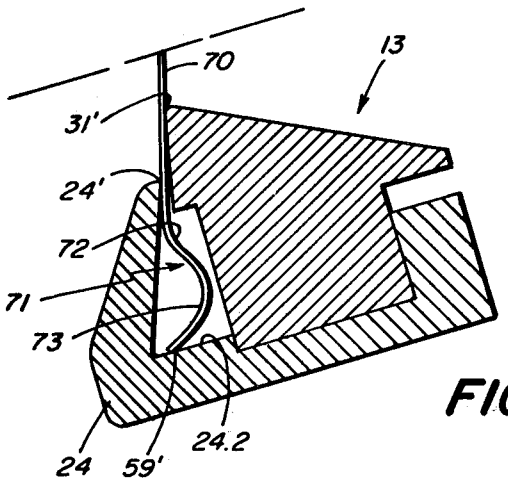
FIG. 7 is an enlarged sectional view of a reverse-curve spring-tab creping blade positioned in a jaw apparatus.

FIG. 7 shows another embodiment of a spring-tab blade 70 mounted in straight blade jaw apparatus 13. Jaw apparatus 13 supports spring-tab blade 70 along contact line edges 31' and 24' in a manner similar to the support of straight blade 11, as previously explained in connection with FIG. 2A. Spring-tab blade 70 has a reverse curve portion at its rear part 71 containing a first curve 72 and second curve 73. Blade 70 is in supporting contact with a bottom surface 24.2 of jaw member 24 at rear edge location 59'.

Figure 8:
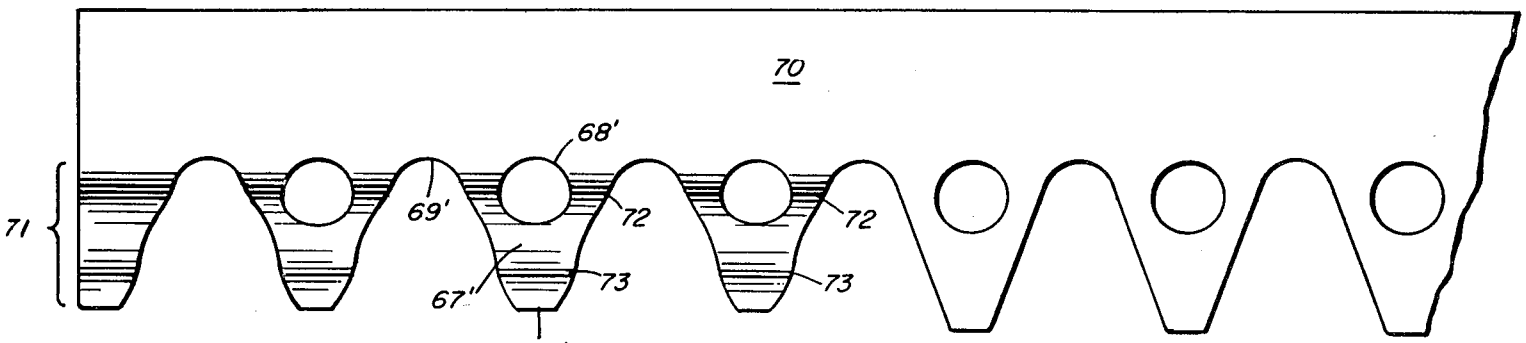
FIG. 8 is a side view of a creping blade as shown in FIG. 7.

FIG. 8 is a plan view of the spring-tab configuration of blade 70, shown in the curved portions 72, 73 near the rear edge 59'. The blade 70 has tabs 67', grooves 69' and holes 68' providing blade flexibility similar to that of the spring-tab blade 11' shown in FIGS. 5 and 6.

In operation, a reverse curve (an "S" curve) as in blade 70 can provide greater longitudinal edge-wise flexibility in the blade 70 than is available in a straight blade such as the blade 11. Thus, in having the ability to deflect a greater distance each spring tab 67' can compensate for greater load variations present on the working edge of the blade. Additionally, the blade 70 can be used with the straight blade jaw apparatus 13 of FIG. 2A, affording the owner of jaw apparatus 13 greater versatility of operation.

The profiling tube 26 is representative of a number of profiling mechanisms that exist in the art, some of which will be found in patents mentioned above in connection with blade flexure and roll-contact problems.

FIG. 9 illustrates the invention more generally than has up to now been described. The generalized bladeholder 130, which like the bladeholder 13 may be mounted to the doctor back 14, for example, has a slot-like jaw space 134 bounded by sidewalls 132 and 133 and a bottom wall 135. A pivot support 131 is provided at the extremity of the first side wall 132, and the blade 110 makes pivotal contact with that support when the forward, or working edge 111 of the blade is in frictional contact with the moving roll surface 12. The pivot support 131 extends substantially parallel to the roll axis, and makes contact with the blade in a first line (not shown) in the down-stream wide side 109 of the blade. A second blade-contact support 124 is provided at the extremity of the second side wall 133. When the blade pivots around the pivot support 131 it makes contact with the second support 124 along a second line (not shown) in the up-stream wide side 108, on which creping takes place. The second contact line is a greater distance from the working edge 111 than is the first contact line and, as long as the blade, in use, pivots around the first pivot support 131 into contact with the second support 124 it will operate stably.

The sloped bottom wall 135, which slopes away from the roll surface 12, from the first or down-stream jaw-space wall 132 to the second wall 133, aids in establishing stability of blade contact with the roll, in that when the bladeholder 130 is urged toward the roll surface 12 (by the doctor back 14, for example) the back edge 112 of the blade is deflected toward the second, or up-stream, wall 133, being forced to slide "down" the bottom wall 135 in reaction to the force of contact with the roll surface. A further advantage of the sloped bottom wall 135 is that it will cause the blade 110 to flex slightly around the second support 124, and contribute to resilience in the longitudinal direction, thereby enabling the blade to conform with minor variations in the roll surface 12 in the axial direction.

Figure 1:
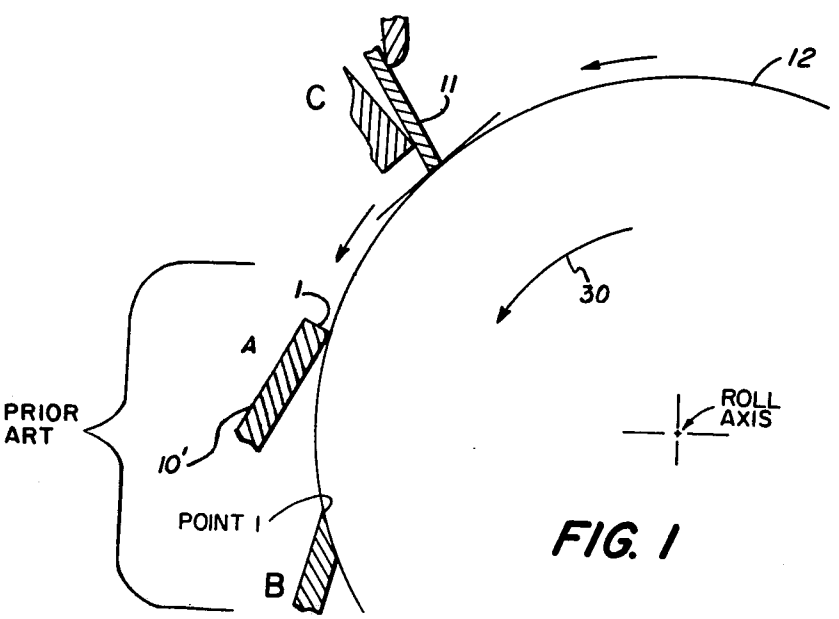
FIG. 1 is a schematic view comparing a prior art creping blade and a creping blade according to the invention.

The acute approach angle, less than 90° between the tangent to the roll surface 12 and the width dimension of the blade, which is illustrated in FIG. 1 at position C, and in the embodiment of FIGS. 2, 5 and 7, which may be termed a "drag angle" assures stable operation of the blade 11 against the roll surface 12, in that when the doctor back 14 urges the bladeholder 13 or 13' toward the roll surface 12, the force of contact between the roll surface and the blade will deflect the blade toward the pivot contact 31' or 31'', rspectively, without aid from the force of friction that is imposed by the moving roll surface 12. With the bladeholder illustrated in FIG. 9, it is not necessary to bring the blade 110 to the roll surface 12 at a drag angle to achieve stability without aid of such force of friction, i.e.: when the roll surface 12 is not moving. However, when the approach angle is greater than 90°, it is preferred to bevel the working edge 111, as is illustrated in FIG. 10.

The bladeholder 130 can be fitted with blade retainer means (not shown) like the shoulder 53 in FIG. 2A, if desired. Also, the bladeholder 130 can use blades having resilient back-portion structures, for example, the "S" curved blade of FIG. 7..

FIG. 11 shows another form of blade which can be used to advantage in bladeholders 13 or 130 of the invention. This blade is a modification of blade 111 in which a series of slots 116 is cut in the back edge 112 to provide a series of stems 115 of about equal width to the slots, extending from the back edge 112 toward the working edge 111. The blade is relieved in its rear portion so that it can flex about its longitudinal dimension in the plane of its wide walls 108, 109, thereby further enhancing its ability to comply with minor variations in the roll surface 12 in the axial direction. Further enhancing this capability is that the stems 115 can more readily "slide downw" the bottom wall 135 of the jaw space 134 in reaction to contact force imposed when the blade 110 is brought into contact with the roll surface 12. This capability is also useful to permit the working edge 111 to expand longitudinally when heated by friction; without relief in its rear portion, the blade would resist such expansion of the working edge, which would then be put under longitudinal compressive stress, tending to give rise to edge ripple as a self-relieving result.

Although the foregoing description of this doctor has been primarily associated with production of crepe paper, it is to be understood that its advantages will be beneficial to other products and industries. For example, many chemicals and foods are processed on drum dryers and flakers where these materials are dried or crystallized on a moving belt or rotating drum, and a conventional doctor is used to remove these products from the surface of the belt or drum. Removal is in the form of sheets, flakes or granules, depending upon the nature of the product, its adhesion to the moving surface, and the configuration of the doctor blade working edge. Frequently, the size of the granules and flakes must be controlled and produced to a prescribed uniformity. The present invention, providing relatively unchanging geometry of the working blade edge, with progressive wear, as compared to changes experienced with conventional blades, will provide essentially the same advantages to the production of these other products, as for the production of creped papers.

I claim:

1. In a creping doctor for creping paper and like products from a surface of a moving body carrying the product, a bladeholder for presenting to the surface an elongated blade having a width dimension that is many times its thickness dimension, with the width dimension being generally normal to said surface and with a narrow edge of the blade being in frictional contact with said surface, for creping said product on a wide upstream side of said blade, said blade holder having first means for pivotally supporting said blade along a first contact line on a wide downstream side of said blade in reaction to frictional force imposed on said edge by said moving body surface, said first contact line being substantially parallel to said edge, and second means for supporting said blade along a second contact line on said wide upstream side in reaction to pivotal motion of said blade around said first contact line, said first contact line being nearer to said edge than said second contact line.

2. A creping doctor according to claim 1 wherein said bladeholder has a blade-receiving slot bounded by first and second side walls and a bottom wall, said first means being supported from said first wall and said second means being supported from said second wall, said blade resting edgewide on said bottom wall.

3. A creping doctor according to claim 2 wherein said bottom wall is substantially flat and slopes away from said moving body surface, from said first side wall to said second side wall.

4. A creping doctor according to claim 3 in combination with a blade that has a plurality of transverse slots arrayed side-by-side along the length of the blade, each slot extending from the edge resting on said bottom wall toward the edge contacting said moving body surface.

5. A creping doctor according to claim 2 in combination with a blade that has a plurality of transverse slots arrayed side-by-side along the length of the blade, each slot extending from the edge resting on said bottom wall toward the edge contacting said moving body surface.

6. A creping doctor for creping paper and like products from a surface of a roll that is turnable about its axis to advance said surface in a first direction, comprising a bladeholder having first and second jaws defining between them a jaw opening that is elongated substantially parallel to said axis and has a width dimension extending generally radially to said axis for receiving and holding between said jaws an elongated blade having a front working edge in working contact with said surface and a back edge within the opening, means within the jaw opening for engaging said back edge, said second jaw being forward of said first jaw relative to said first direction, said first jaw having means for pivotally contacting a downstream side of said blade along a first contact line between said working and back edges of said blade, said second jaw having means for contacting an upstream side of said blade along a second contact line between said working and back edges of said blade, said first contact line being nearer to said roll surface than said second contact line, whereby when said working edge engages said surface of said roll while said roll is turning about said axis, said blade can move pivotally around said first contact line to engage said second jaw along said second contact line, and during use said product on said surface of said roll encounters said upstream side of said blade.

7. A creping doctor according to claim 6 wherein said first jaw member has a first jaw surface confronting said surface of said roll advancing in said first direction, said jaw surface being flat and oriented substantially normal to said tangent during said use, said first jaw surface terminating in a first jaw lip edge in contact with said downstream side along said first contact line, said second jaw member having a second jaw lip edge spaced a greater distance from said roll surface than said first jaw lip edge and in contact with said upstream side along said second contact line, said jaw opening extending widthwise from said lip edges away from said roll between said jaws and having a bottom portion remote from said roll for receiving and supporting the back edge of said blade.

8. A creping doctor according to claim 7 wherein said first jaw surface is undercut at the bottom of said jaw space generally in said first direction away from said second jaw member, and the inner surface of said second jaw member is curved toward said undercut on an axis that is parallel to said roll axis, whereby said jaw space changes direction toward said first direction at the bottom portion thereof.

9. The creping doctor according to claim 6 wherein said blade has integral resilient means distributed along the back edge thereof for resiliently engaging said back-edge engaging means, said resilient means being deformable in the direction of said width dimension for urging said working edge against said roll throughout the length of said blade.

10. A bladeholder apparatus for creping a web of paper or the like on a surface of a roll rotating to move said surface in a prescribed direction, comprising:

a doctor back providing a reference platform;

a plurality of pressure finger means arrayed side-by-side on said back, each finger being rotatably mounted at one end to said back in a common axis;

a pad attached to each pressure finger means at its other end and confronting said reference platform;

resilient profiling means positioned on said doctor back between said reference platform and all of said pads;

bladeholder means mounted on said pressure finger means at said other end of each on the sides thereof opposite said pads;

spring means disposed between adjacent pairs of said pressure finger means, each said spring means being supported at one extremity by said pads and at the other extremity by a member between said adjacent pairs; and means for holding said spring means to said doctor back intermediate said extremities so as to cause said spring means to present a pre-loading force on said profiling means.

11. A bladeholder apparatus according to claim 10 wherein said profiling means comprises a flexible tube enclosing pressurized fluid means to produce a counter force throughout its length when force is applied to said flexible tube by any one of said pads.

12. A bladeholder apparatus according to claim 10 wherein said bladeholder means comprises a first jaw member and a second jaw member defining between them a jaw opening for receiving and supporting an elongated blade oriented with its width dimension substantially perpendicular to said reference platform.

13. A bladeholder apparatus according to claim 12 in combination with a blade comprising an elongated strip of metal having a forward working edge intended to be in contact with said roll surface and a rear edge intended to be in flexible supporting contact with said bladeholder means within said jaw opening, said rear edge being configured in a tab-groove arrangement wherein each tab is curved essentially toward the direction of roll surface movement so that said tabs provide blade flexibility in a direction which is substantially normal to said roll surface.

14. A bladeholder apparatus according to claim 12 in combination with a blade comprising an elongated strip of metal having a working edge intended to be in contact with said roll surface and a rear edge intended to be in flexible supporting contact with said bladeholder means, said rear edge being configured to have a first portion curved essentially toward the direction of roll surface movement and a second portion curved essentially opposite to the direction of roll surface movement, said first curved portion and said second curved portion being configured into a tab-groove arrangement wherein each tab along said rear edge is in contact with said bladeholder means within said jaw opening to provide blade flexibility in a direction which is substantially normal to said roll surface.

15. A creping doctor comprising:

a doctor blade;

doctor support and positioning means;

a plurality of elongated pressure fingers arrayed side by side and each being rotatably mounted at one end to said support and positioning means;

pads mounted to said pressure fingers near the other end of each;

flexure compensating means positioned on said support and positioning means between the latter and said pads;

pressure producing means operable on said pads so as to cause said flexure compensating means to be in contact with said pads of said pressure fingers; and bladeholder means having a jaw space attached to said pressure fingers at said other ends to secure and position said blade, said bladeholder means being oriented to hold a blade in said jaw space with its width dimension substantially perpendicular to the length dimension of said fingers.

16. In a creping doctor for removing paper and like products from a surface of a roll that is turnable about its axis to advance said surface in a first direction, a blade holder, comprising jaw means having first and second rigid jaws fixed relative to each other and defining between them a jaw opening that is elongated substantially parallel to said axis and has a width dimension extending substantially normal to said surface for receiving and holding between said jaws an elongated blade having a front working edge in working contact with said surface and a back edge within the opening, means within the jaw opening for engaging said back edge, said second jaw being forward of said first jaw relative to said first direction, said first jaw having at its extremity confronting said roll surface a lip edge that is nearer to said roll surface during operative use of said doctor than is a lip edge at the extremity of said second jaw confronting said roll surface, said jaw opening providing space wherein said blade can rock around said first jaw lip edge into contact with said second jaw lip edge, whereby when during said operative use said working edge engages said surface of said roll while said roll is turning about said axis said blade is forced at a second side to engage said lip edge and said first jaw pivotally along a first contact line and in consequence to engage at its first wide side the lip edge of said second jaw along a second contact line further from said working edge than said first contact line, means for yieldably urging said jaw means towards said roll surface and into an operative position at which said working edge is in contact with said roll surface, said lip edges being configured relative to each other, and to said surface during said operative use, so as to hold said blade along said first and second contact lines with said width dimension oriented at an angle relative to said roll surface such that creping is occasioned by the paper and like products encountering said first wide side.

17. In a creping doctor employing a doctor blade to crepe a product from a moving carrier surface, the said doctor blade having a front edge with upstream and downstream sides extending rearwardly therefrom to a back edge, a bladeholder comprising: jaw means for receiving and supporting said blade, said jaw means being in contact with said blade at the back edge thereof as well as at first and second contact lines extending respectively along said downstream and upstream sides, said contact lines being parallel to said front edge with the first contact line along said downstream side being closer to said front edge than the second contact line along said upstream side; and support means for yieldably urging said jaw means towards said carrier surface and into an operative position at which the front edge of said blade is in contact with said carrier surface and the angular disposition of said blade relative to said carrier surface is such that creping is occasioned by the product encountering said upstream side.

18. The blade holder of claim 17 wherein said jaw means has a blade-receiving slot bounded by first and second side walls and a bottom wall, said first side wall having support means in contact with the downstream side of said blade along said first contact line, said second side wall having a support means in contact with the upstream side of said blade along said second contact line, and said bottom wall being in contact with the back edge of said blade.

19. The blade holder of claim 18 wherein said bottom wall slopes away from said moving carrier surface, from said first side wall to said second side wall.

20. The blade holder of claims 18 or 19 in combination with a blade having a plurality of transverse slots arrayed side by side along the back edge of said blade.

21. The blade holder of claim 18 in combination with a blade having integral resilient means distributed along the back edge thereof for resiliently engaging said bottom wall, said resilient means being deformable for urging said front edge against said carrier surface.

22. A method for removing or creping a thin sheet of material from a moving carrier surface by means of a doctor blade having an elongate working edge with flat front and rear faces extending width-wise therefrom, said method comprising:

supporting the blade transversely to the direction of movement of the carrier surface and applying the blade to the carrier surface so that its working edge is in frictional engagement with the carrier surface;

maintaining the blade so that it lies substantially along a plane which is generally normal to the direction of movement of the carrier surface, thereby to present a region of the front face adjacent to the working edge to the continually advancing sheet;

supporting the blade by engagement with its rear face along a longitudinally extending pivot line to resist the frictional force imparted to the blade at the working edge by the moving carrier surface while permitting the blade to pivot about said pivot line; and, applying a reaction force to the front face of the blade at a location more remote from the working edge than the pivot line, to control the extent to which the blade may pivot about the pivot line and to maintain the blade stably in said plane.

* * * * *